US009199468B2

(12) United States Patent
Kobayashi et al.

(10) Patent No.: US 9,199,468 B2
(45) Date of Patent: Dec. 1, 2015

(54) LIQUID DISCHARGING APPARATUS AND METHOD OF CLEANING DISCHARGE HEAD

(71) Applicant: SEIKO EPSON CORPORATION, Tokyo (JP)

(72) Inventors: Yoshihiro Kobayashi, Matsumoto (JP); Toshio Kumagai, Shiojiri (JP); Norihiro Masuda, Matsumoto (JP); Katsuyoshi Onodera, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/193,640

(22) Filed: Feb. 28, 2014

(65) Prior Publication Data

US 2014/0253633 A1 Sep. 11, 2014

(30) Foreign Application Priority Data

Mar. 7, 2013 (JP) ..... 2013-045074

(51) Int. Cl.
*B41J 2/165* (2006.01)
*B41J 25/00* (2006.01)

(52) U.S. Cl.
CPC ..... *B41J 2/16535* (2013.01); *B41J 2/16552* (2013.01); *B41J 2/16588* (2013.01); *B41J 2025/008* (2013.01)

(58) Field of Classification Search
USPC ..... 347/33
See application file for complete search history.

(56) References Cited

U.S. PATENT DOCUMENTS

| | | | | |
|---|---|---|---|---|
| 5,793,390 | A * | 8/1998 | Claflin et al. | 347/33 |
| 6,286,933 | B1 * | 9/2001 | Murakami et al. | 347/47 |
| 2004/0212657 | A1 * | 10/2004 | Tee et al. | 347/33 |
| 2004/0227784 | A1 | 11/2004 | Lodal et al. | |
| 2005/0035991 | A1 * | 2/2005 | Fredrickson | 347/33 |
| 2010/0201738 | A1 * | 8/2010 | Yamaguchi et al. | 347/31 |

FOREIGN PATENT DOCUMENTS

| | | | |
|---|---|---|---|
| JP | 2000-203041 | | 7/2000 |
| JP | 2003-311989 | | 11/2003 |
| JP | 2004-009417 | | 1/2004 |
| JP | 2005022251 | A * | 1/2005 |
| JP | 2006-327004 | | 12/2006 |
| JP | 2007-216496 | | 8/2007 |
| JP | 2007-276132 | | 10/2007 |
| JP | 2009-233896 | | 10/2009 |
| JP | 2010-260259 | | 11/2010 |

* cited by examiner

*Primary Examiner* — Jason Uhlenhake
(74) *Attorney, Agent, or Firm* — Workman Nydegger

(57) ABSTRACT

There is provided a liquid discharging apparatus which includes a discharge head that includes a nozzle forming surface on which nozzles for discharging liquid are formed; a wiping member that performs wiping by relatively moving on the nozzle forming surface while abutting on the nozzle forming surface; a cleaning liquid supply unit that supplies cleaning liquid provided for the wiping; and a control unit that performs reciprocating wiping control which performs the wiping by causing the wiping member for holding the cleaning liquid supplied from the cleaning liquid supply unit to perform a reciprocating operation in which, after relative movement is performed in a first direction along the nozzle forming surface, relative movement is performed in a second direction which is opposite to the first direction.

8 Claims, 9 Drawing Sheets

LIQUID DISCHARGING APPARATUS AND METHOD OF CLEANING DISCHARGE HEAD

BACKGROUND

1. Technical Field

The present invention relates to a technology that cleans the nozzle forming surface of a discharge head which discharges liquid, and, in particular, to a technology that performs wiping with a wiping member on the nozzle forming surface using cleaning liquid.

2. Related Art

In the related art, a liquid discharging apparatus, such as an ink jet printer, which discharges liquid, such as ink or the like, from the nozzles of a discharge head is known. In such an apparatus, there is a case in which the liquid discharged from the nozzles adheres to the nozzle forming surface of the discharge head. If the liquid adheres to the nozzle forming surface, there is a problem in that the liquid is not appropriately discharged from the nozzles, thereby causing deterioration of image quality. Here, various technologies for removing liquid which adheres to the nozzle forming surface of a discharge head are proposed.

For example, a head cleaning apparatus disclosed in JP-A-2009-233896 is provided with a cleaning unit, which includes an ejecting unit that ejects cleaning liquid onto a nozzle forming surface and a wiping member, in order to remove liquid which adheres to the nozzle forming surface. Further, when the nozzle forming surface is cleaned, a discharge head is moved in a direction which is retracted from a platen. When the discharge head passes through a region which the cleaning unit in the process faces, the cleaning liquid is ejected onto the nozzle forming surface by the ejecting unit and a wiping member wipes the nozzle forming surface, and thus the nozzle forming surface is cleaned.

Here, in order to effectively clean the nozzle forming surface using the cleaning liquid, it is necessary that the cleaning liquid is sufficiently spread on the nozzle forming surface. However, in the head cleaning mechanism disclosed in JP-A-2009-233896, after the cleaning liquid is ejected onto the nozzle forming surface, the wiping member wipes the nozzle forming surface one time in one direction, with the result that the cleaning liquid is not sufficiently spread thereon, and thus there is a problem in that effective cleaning is not performed.

SUMMARY

An advantage of some aspects of the invention is to provide a technology that is capable of performing effective cleaning by spreading sufficient cleaning liquid on a nozzle forming surface when the nozzle forming surface of a discharge head is wiped using the cleaning liquid.

According to an aspect of the invention, there is provided a liquid discharging apparatus including: a discharge head that includes a nozzle forming surface on which nozzles for discharging liquid are formed; a wiping member that performs wiping by relatively moving on the nozzle forming surface while abutting on the nozzle forming surface; a cleaning liquid supply unit that supplies cleaning liquid provided for the wiping; and a control unit that performs reciprocating wiping control which performs the wiping by causing the wiping member for holding the cleaning liquid supplied from the cleaning liquid supply unit to perform a reciprocating operation in which, after relative movement is performed in a first direction along the nozzle forming surface, relative movement is performed in a second direction which is opposite to the first direction.

In addition, according to another aspect of the invention, there is provided a method of cleaning a discharge head in a liquid discharging apparatus which includes the discharge head that includes a nozzle forming surface on which nozzles for discharging liquid are formed, and a wiping member that performs wiping by relatively moving on the nozzle forming surface while abutting on the nozzle forming surface, including: supplying the cleaning liquid provided for the wiping; and performing the wiping by causing the wiping member, which holds the cleaning liquid supplied in the supplying of the cleaning liquid, to perform a reciprocating operation in which, after relative movement is performed in a first direction along the nozzle forming surface, relative movement is performed in a second direction which is opposite to the first direction.

In the liquid discharging apparatus and the method of cleaning the discharge head, the wiping is performed in such a way that the wiping member performs relative movement on the nozzle forming surface in a state in which the wiping member abuts on the nozzle forming surface. Further, when the cleaning liquid which is provided for the wiping is used, the nozzle forming surface is suitably cleaned. At this time, according to the aspect of the invention, the wiping is performed by causing the wiping member which holds the supplied cleaning liquid to perform the reciprocating operation in which, after the relative movement is performed in the first direction along the nozzle forming surface, the relative movement in the second direction which is opposite to the first direction is performed. That is, after the cleaning liquid is supplied, the wiping member which holds the cleaning liquid performs the reciprocating operation in which the wiping member performs relative movement in both directions, that is the first direction and the second direction. Therefore, the cleaning liquid is sufficiently spread on the nozzle forming surface. As a result, it is possible to perform effective cleaning using the cleaning liquid. Meanwhile, the cleaning liquid may be directly supplied to the wiping member, and may be supplied to the wiping member through other members.

In the liquid discharging apparatus, the control unit may cause the wiping member to perform the reciprocating operation a plurality of times in the reciprocating wiping control. When the wiping member performs the reciprocating operation a plurality of times as above, it is possible to further suitably spread the cleaning liquid. At the same time, since a force which is generated by the wiping member is applied from both directions, that is, from the first direction and the second direction, to an extraneous substance, such as liquid, which adheres to the nozzle forming surface a plurality of times, it is possible to realize suitable scraping.

In addition, in the reciprocating wiping control, the control unit may perform low speed control in which first relative movement of the wiping member is performed in at least the first direction at a first speed, and high speed control in which the relative movement of the wiping member is performed at a second speed which is faster than the first speed after the low speed control is performed. As above, when the low speed control in which the speed of the wiping member is relatively low is performed in the initial wiping, it is possible to securely spread the cleaning liquid to the nozzle forming surface. Besides, after the low speed control is performed, the high speed control is performed. Therefore, it is possible to prevent time that is necessary for the entire wiping from being long.

In addition, after the reciprocating wiping control is performed, the control unit may further perform cleaning control in which the wiping is performed without supplying the cleaning liquid after the liquid is discharged from the nozzles. In the cleaning control, first, when the liquid is discharged from the nozzles, it is possible to release the cleaning liquid, which comes in the nozzles, from the nozzles when the wiping is performed under the reciprocating wiping control. Subsequently, when the wiping is performed without using the cleaning liquid in the cleaning control, it is possible to prevent the cleaning liquid from coming in the nozzles and to clean the nozzle forming surface which is stained when the liquid is discharged.

In this case, the control unit may cause an abutting force, in which the wiping member abuts on the nozzle forming surface and which is acquired when the wiping is performed under the reciprocating wiping control, to be greater than an abutting force acquired when the wiping is performed under the cleaning control. When the wiping is performed under the reciprocating wiping control, it is necessary to spread the cleaning liquid. However, when the wiping is performed under the cleaning control, the cleaning liquid is not supplied, and thus it is not necessary to spread the cleaning liquid. Here, when the abutting force which is applied to the nozzle forming surface by the wiping member is relatively great when the reciprocating wiping control is performed, it is possible to further suitably spread the cleaning liquid to the nozzle forming surface while pressing the cleaning liquid.

In addition, a depression may be formed in a region of the nozzle forming surface on which the nozzles are not formed, and the control unit, when the wiping is performed under the reciprocating wiping control, may cause the wiping member to perform the reciprocating operation such that the wiping member passes through above the depression. For example, when the discharge head includes a unit head in which the nozzles are provided, and a housing in which an accommodation space is formed in order to accommodate the unit head, such a depression may be a groove portion which is formed between the unit head and the housing in a state in which the unit head is accommodated in and fixed to the accommodation space.

As above, when the depression (groove portion) is present on the nozzle forming surface and when the wiping is performed under the reciprocating wiping control, there is a case in which an extraneous substance which is scraped off the nozzle forming surface comes in the depression together with the cleaning liquid. If time elapses in such a state, the extraneous substance comes deep in the depression due to capillary action depending on a shape of the depression, and thus it is difficult to remove the extraneous substance from the depression. Here, as described above, when the reciprocating operation is performed such that the wiping member passes through above the depression, it is possible to perform suitable cleaning by scraping the extraneous substance from the depression together with the cleaning liquid before the extraneous substance comes deep in the depression.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
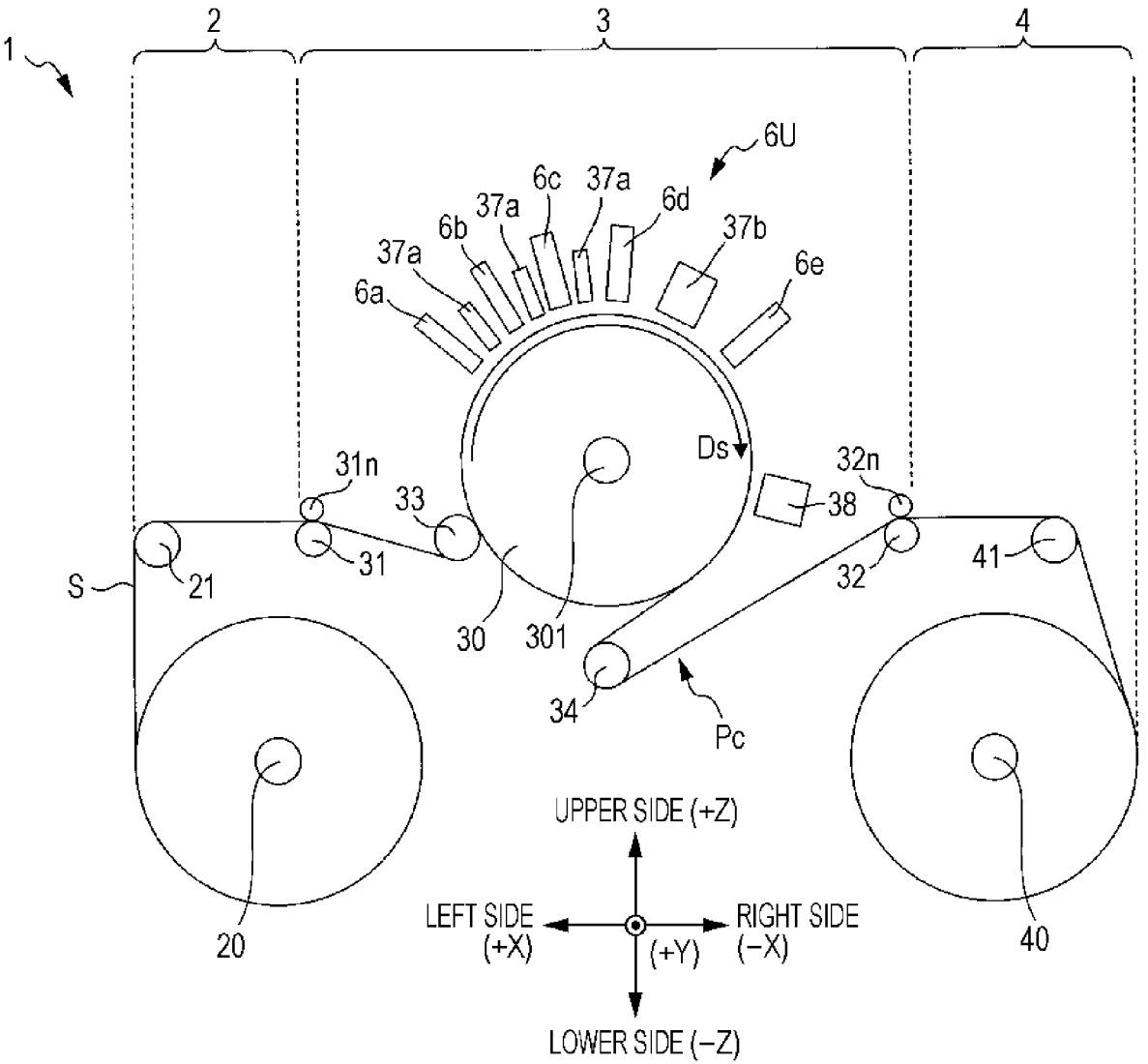
FIG. 1 is a front view illustrating the configuration of a printer to which the invention can be applied.

Hereinafter, the configuration of a printer to which the invention can be applied will be described with reference to the accompanying drawings. FIG. 1 is a front view illustrating the configuration of a printer to which the invention can be applied. Meanwhile, in the drawings below, a 3-dimensional coordinate system which corresponds to the horizontal direction X, the front-back direction Y, and the vertical direction Z of a printer 1 is used if necessary for clarity arrangement relationship between the respective units of the printer 1.

As shown in FIG. 1, in the printer 1, a feeding section 2, a processing section 3 and a winding section 4 are arranged in the horizontal direction. The feeding section 2 and the winding section 4 include a feeding shaft 20 and a winding shaft 40, respectively. Further, both ends of a sheet S (web) are wound around the feeding section 2 and the winding section 4 in a roll shape, and are stretched therebetween. After the sheet S is transported from the feeding shaft 20 to the processing section 3 along a transport path Pc which is stretched as described above and receives an image recording process performed by a print unit 6U, the sheet S is transported to the winding shaft 40. The kind of the sheet S is generally classified into a paper system and a film system. To give a specific example, the paper system includes wood-free paper, cast coated paper, art paper, coated paper and the like, and the film system includes synthetic paper, polyethylene terephthalate (PET), polypropylene (PP), and the like. Meanwhile, in the description below, one surface, on which an image is recorded, of both surfaces of the sheet S is called a front surface, and an opposite side surface thereof is called a back surface.

The feeding section 2 includes the feeding shaft 20 which winds the end of the sheet S, and a driven roller 21 which winds the sheet S that is drawn from the feeding shaft 20. The feeding shaft 20 winds and supports the end of the sheet S in a state in which the front surface of the sheet S faces the outside. Further, when the feeding shaft 20 rotates in the clockwise direction of FIG. 1, the sheet S which is wound by the feeding shaft 20 is fed to the processing section 3 through the driven roller 21.

In the processing section 3, an image is recorded on the sheet S using the print unit 6U while the sheet S which is fed from the feeding section 2 is supported by a platen drum 30. That is, the print unit 6U includes a plurality of print heads 6*a* to 6*e* which are aligned along the front surface of the platen drum 30. Further, when the print heads 6*a* to 6*e* discharge ink onto the sheet S which is supported by the front surface of the platen drum 30, an image is recorded on the sheet S. In the processing section 3, a front driving roller 31 and a rear driving roller 32 are provided on both sides of the platen drum 30, the sheet S which is transported from the front driving roller 31 to the rear driving roller 32 is supported by the platen drum 30, and the reception of image print is performed thereon.

The front driving roller 31 includes a plurality of minute protrusions which are formed through thermal spraying on an outer peripheral surface, and winds the sheet S, which is fed from the feeding section 2, from the back surface side. Further, when the front driving roller 31 rotates in the clockwise direction of FIG. 1, the sheet S which is fed from the feeding section 2 is transported to the platen drum 30 through a driven roller 33. Meanwhile, a nip roller 31*n* is provided for the front driving roller 31. The nip roller 31*n* abuts on the front surface of the sheet S while being energized to a side of the front driving roller 31, and interposes the sheet S with the front driving roller 31. Therefore, the friction force is secured between the front driving roller 31 and the sheet S, and thus it is possible to reliably transport the sheet S by the front driving roller 31.

The platen drum 30 is a cylindrical-shaped drum which is rotatably supported by a support mechanism which is not shown in the drawing, and winds the sheet S which is transported from the front driving roller 31 to the rear driving roller 32 from the back surface side. The platen drum 30 supports the sheet S form the back surface side while performing driven rotation in the transport direction Ds of the sheet S by receiving the friction force between the platen drum 30 and the sheet S. In addition, in the processing section 3, the driven rollers 33 and 34 which fold back the sheet S are provided on both sides of the winding section to the platen drum 30. The driven roller 33 of the rollers winds the front surface of the sheet S between the front driving roller 31 and the platen drum 30, and folds back the sheet S. In contrast, the driven roller 34 winds the front surface of the sheet S between the platen drum 30 and the rear driving roller 32, and folds back the sheet S. As described above, when the sheet S is folded back on each of the upstream and downstream sides of the transport direction Ds for the platen drum 30, it is possible to secure a long winding section of the sheet S for the platen drum 30.

The rear driving roller 32 includes a plurality of minute protrusions which are formed through thermal spraying on an outer peripheral surface, and winds the sheet S which is transported from the platen drum 30 through the driven roller 34 from the back surface side. Further, when the rear driving roller 32 rotates in the clockwise direction of FIG. 1, the sheet S is transported to the winding section 4. Meanwhile, a nip roller 32*n* is provided for the rear driving roller 32. The nip roller 32*n* abuts on the front surface of the sheet S while being energized to a side of the rear driving roller 32, and interposes the sheet S with the rear driving roller 32. Therefore, the friction force is secured between the rear driving roller 32 and the sheet S, and thus it is possible to reliably transport the sheet S by the rear driving roller 32.

As described above, the sheet S which is transported from the front driving roller 31 to the rear driving roller 32 is supported by the outer peripheral surface of the platen drum 30. Further, in the processing section 3, the plurality of print heads 6*a* to 6*d* corresponding to colors which are different from each other are provided in order to record a color image on the front surface of the sheet S which is supported by the platen drum 30. More specifically, four print heads 6*a* to 6*d* corresponding to yellow, cyan, magenta, and black are aligned in the order of the colors along the transport direction Ds.

The print heads 6*a* to 6*d* include the same configuration as each other, and face the front surface of the sheet S which is supported by the platen drum 30 with some clearance. Further, the print heads 6*a* to 6*d* discharge ink corresponding to colors from nozzles which open toward the front surface of the platen drum 30 using an ink jet method. Therefore, ink is discharged onto the sheet S which is transported along the transport direction Ds, and the color image is formed on the front surface of the sheet S.

Here, ultraviolet (UV) ink (photocurable ink), which is cured by irradiation of ultraviolet (light), is used as ink (recording liquid). Here, in order to cure the ink and fix the ink to the sheet S, UV lamps 37*a* and 37*b* are provided. Meanwhile, the ink curing is performed by dividing into two stages, that is, temporary curing and main curing. The UV lamps 37*a* for the temporary curing are arranged between the respective print heads 6*a* to 6*d*. That is, the UV lamps 37*a* perform curing (perform the temporary curing) on ink to the extent that the shape of the ink does not collapse by irradiating weak ultraviolet, and do not perform complete curing on ink. In contrast, the UV lamp 37*b* for the main curing is provided on the downstream side of the transport direction Ds with regard to the print heads 6*a* to 6*d*. That is, the UV lamp 37*b* performs complete curing (performs the main curing) on ink by irradiating stronger ultraviolet than the UV lamps 37*a*. When the temporary curing and the main curing are performed as described above, it is possible to fix the color image which is formed by the print heads 6*a* to 6*d* to the front surface of the sheet S.

Further, the print head 6*e* is arranged to face the front surface of the platen drum 30 on the downstream side of the UV lamp 37*b* in the transport direction Ds. The print head 6*e* includes the same configuration as that of each of the print heads 6*a* to 6*d*, and discharges transparent UV ink to the front surface of the sheet S using the ink jet method. That is, the print head 6*e* faces the front surface of the sheet S which is supported by the platen drum 30 with some clearance, and discharges transparent ink using the ink jet method. Accordingly, transparent ink is further discharged to the color image which is formed by the print heads 6*a* to 6*d* corresponding to four colors.

In addition, a UV lamp 38 is provided on the downstream side of the print head 6*e* in the transport direction Ds. The UV lamp 38 performs complete curing (main curing) on transparent ink which is discharged by the print head 6*e* by irradiating strong ultraviolet. Accordingly, it is possible to fix transparent ink to the front surface of the sheet S.

As described above, in the processing section 3, the color image which is coated with transparent ink is formed by appropriately discharging and curing ink on the sheet S which is supported by the platen drum 30. Further, the sheet S on which the color image is formed is transported to the winding section 4 by the rear driving roller 32.

The winding section 4 includes a winding shaft 40 which winds the end of the sheet S, and a driven roller 41 which winds the sheet S transported to the winding shaft 40. The winding shaft 40 winds and supports the end of the sheet S in a state in which the front surface of the sheet S faces the outside. Further, when the winding shaft 40 rotates in the clockwise direction of FIG. 1, the sheet S is wound around the winding shaft 40 through the driven roller 41.

Figure 2:
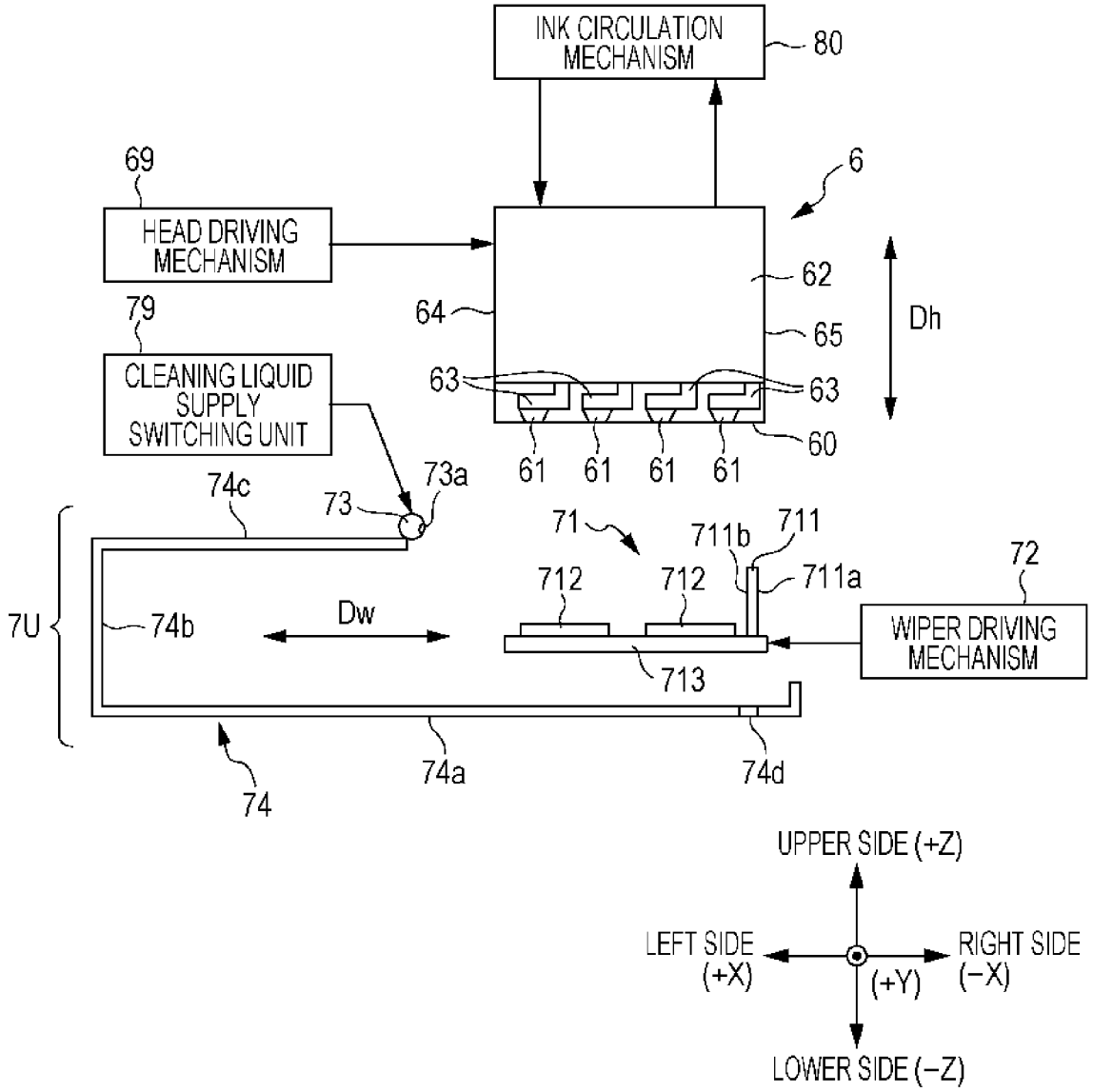
FIG. 2 is a schematic view illustrating an example of the configuration of a maintenance system.

However, a maintenance system, which performs maintenance on the print heads 6*a* to 6*e*, is provided in the printer 1. FIG. 2 is a schematic view illustrating an example of the configuration of the maintenance system. Meanwhile, since each of the print heads 6*a* to 6*e* has the same configuration, hereinafter, any one of the print heads 6*a* to 6*e* is expressed as a print head 6 without performing classification on the print heads 6*a* to 6*e*, and maintenance which is performed on the print head 6 will be described. Meanwhile, hereinafter, for convenience of explanation, a case in which a nozzle forming surface 60 is substantially horizontal as shown in FIG. 2 will be described.

A maintenance unit 7U which is provided in the maintenance system is arranged, one for each print head 6, and performs maintenance, such as wiping, capping, and the like, on the print head 6. The maintenance unit 7U is provided to be close to the platen drum 30 in the Y direction. In contrast, the print head 6 is movable between a print location on an upper side of the platen drum 30 and a maintenance location on the upper side of the maintenance unit 7U in the Y direction by the head driving mechanism 69. Further, the print head 6 is movable in a receding direction Dh which is perpendicular to the nozzle forming surface 60 by the head driving mechanism 69 such that it is possible to acquire a cleaning location which is close to the maintenance unit 7U and a retracted location which is separated from the maintenance unit 7U in the maintenance location. Further, when maintenance is performed, the print head 6 is appropriately moved in the receding direction Dh according to a maintenance process.

The print head 6 includes nozzles 61 which open toward the nozzle forming surface 60, a reservoir 62 which temporarily stores ink, and cavities 63 which communicate the nozzles 61 with the reservoir 62. Ink is supplied to the nozzles 61 from the reservoir 62 through the cavities 63. Further, when the cavities 63 apply pressure to ink according to an operational instruction from a control unit 100 (FIG. 3), ink is discharged from the nozzles 61. In addition, an ink circulation mechanism 80 is provided for the print head 6, and the speed, pressure, and the like of ink, which is circulated between a tank that is not shown and that stores ink and the reservoir 62 of the print head 6, are adjusted by the ink circulation mechanism 80.

The maintenance unit 7U includes a moving body 71 which includes a wiper 711, caps 712 and a support member 713 for supporting the wiper 711 and the caps 712 to be integrally moved, a wiper driving mechanism 72 which moves the moving body 71 in the wiping direction Dw along the nozzle forming surface 60, a cleaning liquid supply pipe 73 which ejects cleaning liquid from ejecting holes 73*a*, and a housing 74. Each of the members has a length in the Y direction, which is equal to or greater than that of the print head 6, and it is possible to perform maintenance on the whole area of the nozzle forming surface 60. Further, when the wiper 711 moves in the wiping direction Dw in a state in which wiping surfaces 711*a* and 711*b* abut on the nozzle forming surface 60, wiping is performed. In addition, when the caps 712 adhere to the nozzle forming surface 60 such that the caps 712 cover the entire nozzles 61, and capping is performed.

The cleaning liquid supply pipe 73 includes a plurality of ejecting holes 73*a* which open toward the side of the print head 6 in the Y direction. When the print head 6 is located in the cleaning location which is close to the maintenance unit 7U, the cleaning liquid can be ejected onto a liquid supplied surface 64 which is on the side of the cleaning liquid supply pipe 73 of the print head 6. Here, it is possible to appropriately use liquid, which is suitable for cleaning work, as the cleaning liquid which is supplied for wiping. However, when UV ink is used as in the embodiment, it is preferable to use a solvent which can dissolve cured UV ink. For example, ethyl diglycol acetate (EDGAC), transparent UV ink, or the like may be used as the solvent. In addition, a surfactant or a polymerization inhibitor may be added to the solvent, and the resulting solvent may be used as the cleaning liquid. Meanwhile, the supply of the cleaning liquid, which is performed through the cleaning liquid supply pipe 73, is switched by a cleaning liquid supply switching unit 79.

The housing 74 mainly includes a bottom surface portion 74*a* which is approximately parallel to the wiping direction Dw, a side wall portion 74*b* which is founded from one end of the bottom surface portion 74*a* in the wiping direction Dw, and an eave portion 74*c* which extends to the same side as the bottom surface portion 74*a* from the upper end of the side wall portion 74*b* along the wiping direction Dw. The bottom surface portion 74*a* is provided over a slightly wider range than a range in which the moving body 71 can move in the wiping direction Dw, and receives waste liquid which includes ink or cleaning liquid generated when maintenance is performed. The waste liquid which is received in the bottom surface portion 74*a* is released from the maintenance unit 7U through release holes 74*d* which are formed in the bottom surface portion 74*a*. The dimension of the eave portion 74*c* is greater than that of the moving body 71 in the wiping direction Dw. Further, when the print is operated, the moving body 71 maintains a state in which the moving body 71 is located in a stand-by location on a lower side of the eave portion 74*c* and is covered by the eave portion 74*c*. In this manner, the eave portion 74*c* shields against light (ultraviolet) which is irradiated from the UV lamps 37*a*, 37*b*, and 38, thereby preventing UV ink which adheres to the wiper 711 or the caps 712 from being cured.

Figure 3:
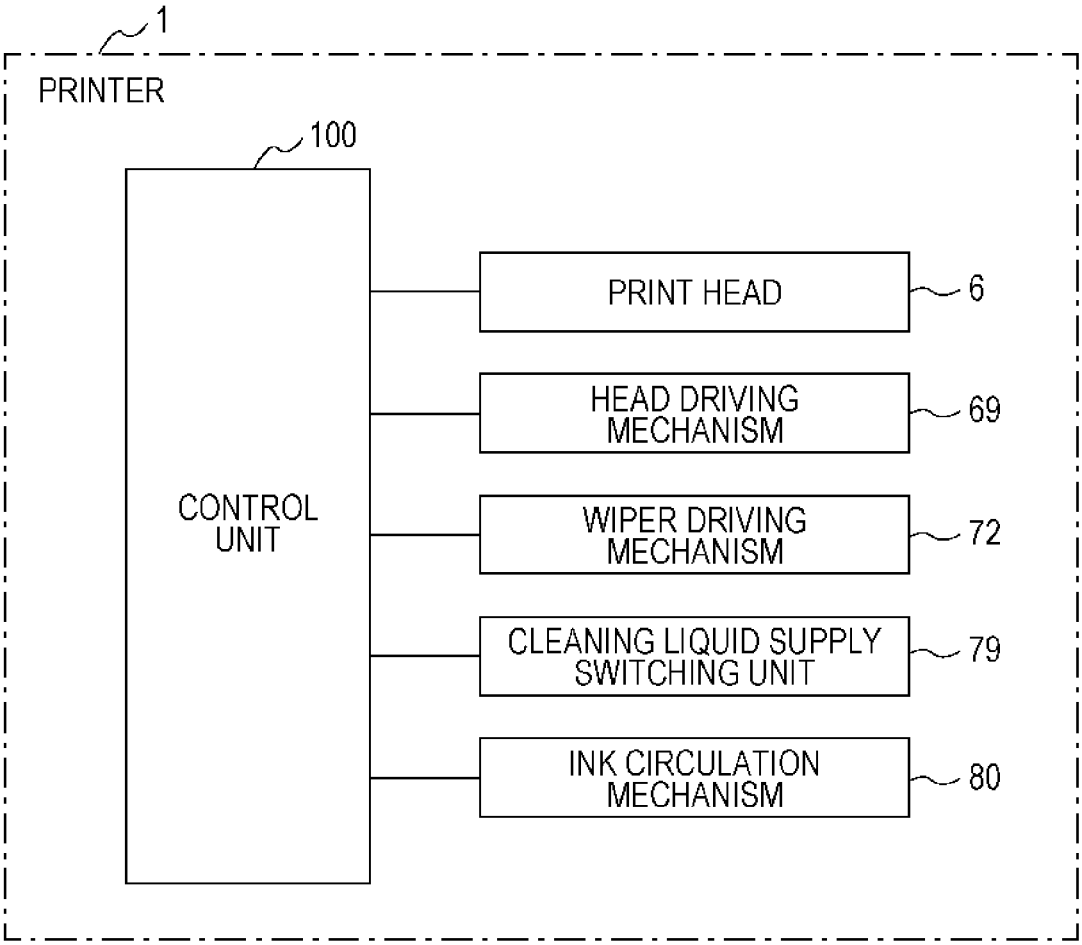
FIG. 3 is a block diagram illustrating the electrical configuration of the maintenance system.

FIG. 3 is a block diagram illustrating an example of the electrical configuration of the maintenance system. The operation of the maintenance system which is configured as described above is controlled by a control unit 100 which is provided in the printer 1. For example, when the control unit 100 controls the head driving mechanism 69, the print head 6 is appropriately arranged in each location, such as the cleaning location, the retracted location, or the like. In addition, when the control unit 100 controls the wiper driving mechanism 72, the moving body 71 is driven and the wiper 711 and the caps 712 perform an operation according to the maintenance process. In addition, when the control unit 100 controls the cleaning liquid supply switching unit 79, a state is switched into a state in which the cleaning liquid is ejected from the ejecting holes 73*a* of the cleaning liquid supply pipe 73 and a state in which the cleaning liquid is not ejected. In addition, when the control unit 100 controls the ink circulation mechanism 80, the circulation speed, the pressure or the like of ink which is supplied to the print head 6 is adjusted.

Figure 4:
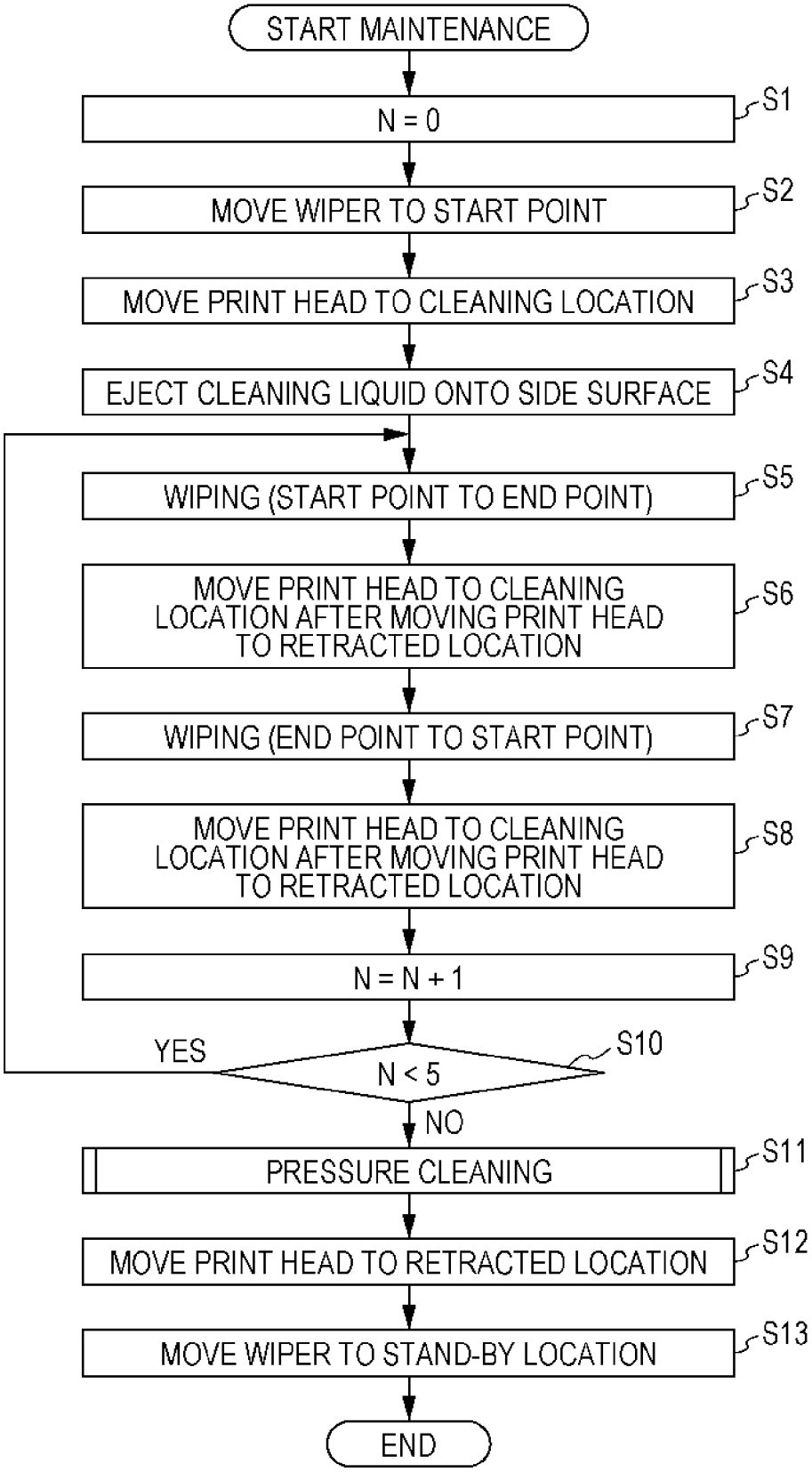
FIG. 4 is a flowchart illustrating flow of maintenance.

Subsequently, the flow of the maintenance performed on the print head 6 using the maintenance unit 7U will be described. FIG. 4 is a flowchart illustrating the flow of the maintenance and FIGS. 5A to 5H are schematic views illustrating the states of the print head and the maintenance unit. In the maintenance which is performed by the maintenance unit 7U, the cleaning liquid is ejected onto the liquid supplied surface 64 which is the side surface of the print head 6. Thereafter, the wiper 711 is caused to perform a reciprocating operation a plurality of times in the wiping direction Dw, and pressure cleaning is further performed. Meanwhile, in the description below, the location of the end of the side of the liquid supplied surface 64 is indicated as a start point P1 in the reciprocating operation of the wiper 711, and the location of the end of the opposite side is indicated as an end point P2.

Figure 5A:
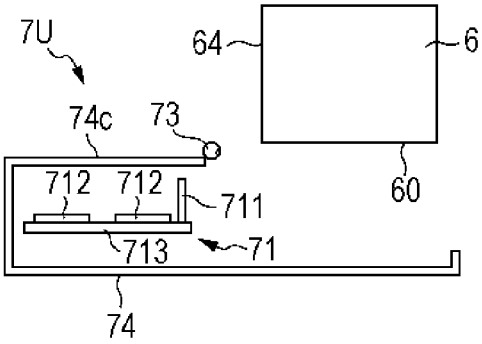
FIGS. 5A to 5H are schematic views illustrating the states of a print head and a maintenance unit.
Figure 5B:
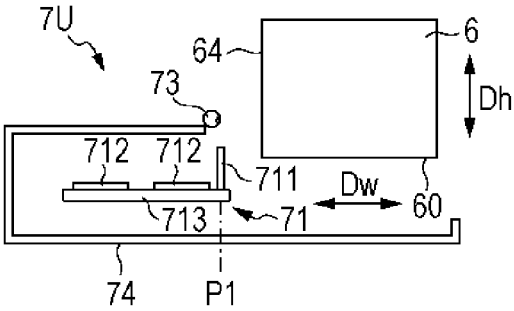

Here, as shown in FIG. 5A, it is assumed that maintenance starts in a state in which the print head 6 is located in the retracted location which is separated from the maintenance unit 7U and the wiper 711 (moving body 71) is located in the stand-by location on the lower side of the eave portion 74*c*. If maintenance starts, first, the number of times N that the wiper 711 performs a reciprocating operation is set to 0 in step S1. Further, according to the operational instruction from the control unit 100, the wiper driving mechanism 72 moves the wiper 711 to the start point P1 in step S2, and the head driving mechanism 69 moves the print head 6 to the cleaning location which is close to the maintenance unit 7U in step S3. As a result, as shown in FIG. 5B, a state in which the tip portion of the wiper 711 faces the liquid supplied surface 64 of the print head 6, in other words, a state in which the wiper 711 partially overlaps with the liquid supplied surface 64 in the receding direction Dh, is acquired. Further, when the wiper 711 moves in the wiping direction Dw in this state, the wiping is performed on the nozzle forming surface 60 by the wiper 711.

Figure 5C:
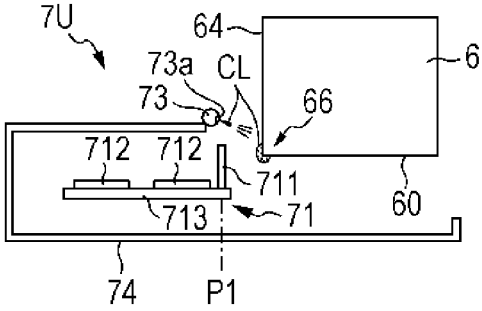

Subsequently, when the control unit 100 gives an operational instruction to supply the cleaning liquid to the cleaning liquid supply switching unit 79, the cleaning liquid is ejected from the ejecting holes 73*a* of the cleaning liquid supply pipe 73 toward the liquid supplied surface 64 of the print head 6 in step S4. The cleaning liquid which is ejected from the ejecting holes 73*a* passes through the upper side of the wiper 711, and lands on the liquid supplied surface 64 without landing on the wiper 711. As shown in FIG. 5C, if a cleaning liquid CL is ejected onto the liquid supplied surface 64, the cleaning liquid CL which adheres to the liquid supplied surface 64 flows to the lower side along the liquid supplied surface 64 and is accumulated in the corner portion 66 between the liquid supplied surface 64 and the nozzle forming surface 60.

Figure 5D:
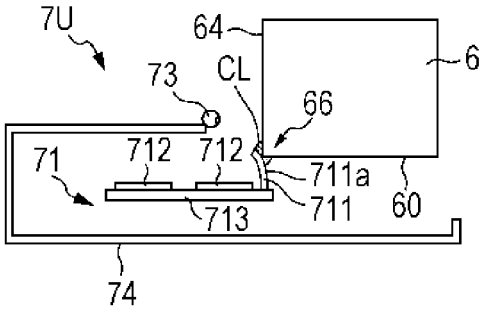

If a sufficient amount of the cleaning liquid is supplied, ejecting of the cleaning liquid stops and the wiping is performed by moving the wiper 711 from the start point P1 to the end point P2 in step S5. In this process, as shown in FIG. 5D, the wiping surface 711*a* of the wiper 711 abuts on the corner portion 66, and the cleaning liquid CL which is accumulated in the corner portion 66 is kept by the wiper 711. Further, the wiping is performed while the cleaning liquid which is kept by the wiper 711 is spread on the nozzle forming surface 60.

Figure 5E:
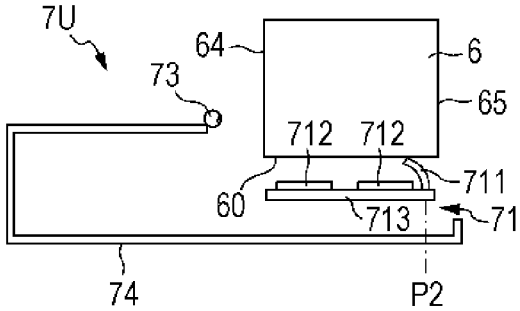

FIG. 5E illustrates a state in which the wiper 711 is moved to the end point P2. The end point P2 of the reciprocating operation performed by the wiper 711 is located on the lower side of the print head 6. A reason for setting the location of the end point P2 to the lower side of the print head 6 as described above is as follows. If the wiper 711 is moved to the right side rather than to the side surface 65 which is on the opposite side of the liquid supplied surface 64, the wiping surface 711*b* of the wiper 711 (FIG. 2) abuts on the side surface 65 when the wiper 711 is subsequently moved toward the start point P1. Since the cleaning liquid is not ejected onto the side surface 65, an extraneous substance, such as cured UV ink or the like, remains. If the wiper 711 abuts on the side surface 65, there is a problem in that the extraneous substance adheres to the wiper 711. Here, when the location of the end point P2 is on the lower side of the print head 6, the wiping surface 711*b* is prevented from abutting on the side surface 65, and excellent wiping is realized.

Figure 5F:
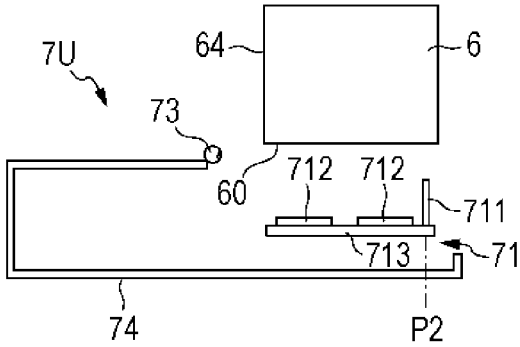
Figure 5G:
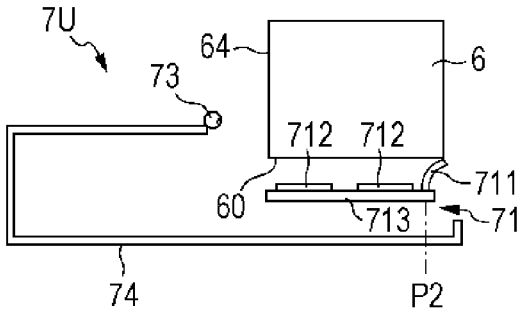

Subsequently, after the print head 6 is moved once to the retracted location, the print head 6 returns to the cleaning location in step S6. When the print head 6 is moved once to the retracted location, a state in which the wiper 711 located at the end point P2 is bent to the left side is eliminated (FIG. 5F). Further, if the wiper 711 is bent to the right side by the nozzle forming surface 60 when the print head 6 returns to the cleaning location as shown in FIG. 5G, the wiper 711 smoothly moves from the end point P2 to the start point P1. Meanwhile, for example, if the wiper 711 is managed such that the wiper 711 is slightly inclined to the right side in the state of FIG. 5F, it is possible to reliably bend the wiper 711 to the right side when the print head 6 returns to the cleaning location.

Figure 5H:
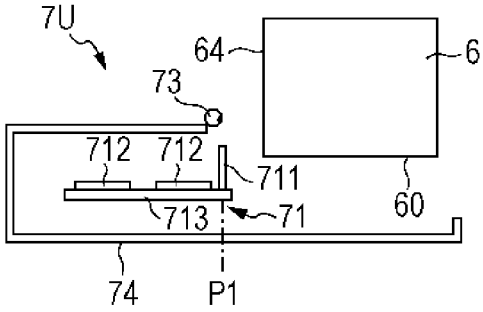

The wiping is performed by moving the wiper 711 from the end point P2 to the start point P1 in a state in which the wiper 711 is bent to the right side in step S7. In this way, if the wiper 711 returns to the start point P1, the reciprocating operation of the wiper 711 is completed one time (FIG. 5H). Subsequently, after the print head 6 is once moved to the retracted location, the print head 6 is moved to the cleaning location again in step S8. Further, after the control unit 100 increases the number of times N that the wiper 711 performs the reciprocating operation in step S9, the control unit 100 determines whether or not the reciprocating operation is performed by five times in step S10. The process returns to step S5 and repeats the reciprocating operation if the number of times of the reciprocating operation is less than 5 times, and the pressure cleaning is performed subsequently if the number of times of the reciprocating operation reaches five times in step S11. If the pressure cleaning is completed, the print head 6 is finally moved to the retracted location in step S12, the wiper 711 is moved to the stand-by location in step S13, and the process returns to the state of FIG. 5A.

Figure 6:
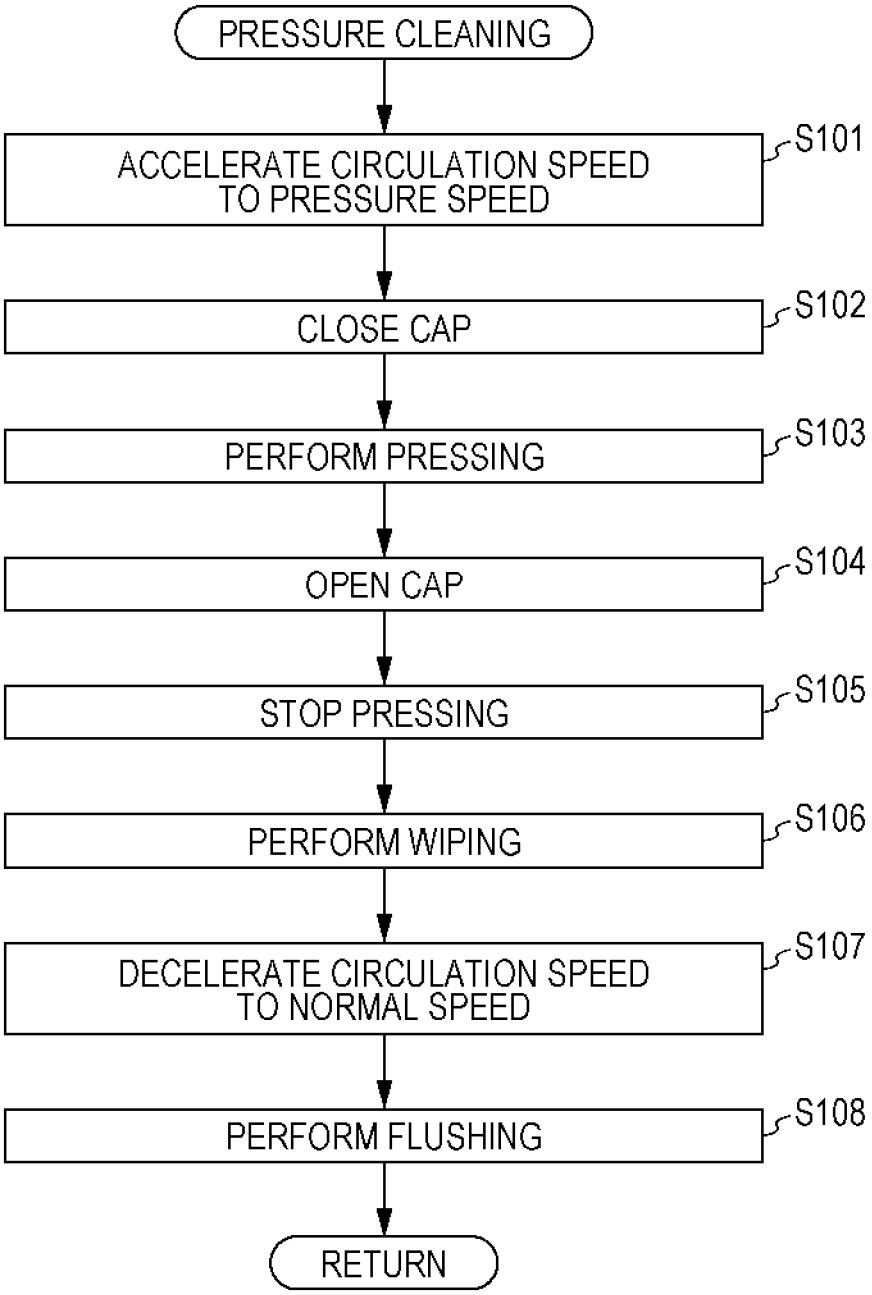
FIG. 6 is a flowchart illustrating the flow of pressure cleaning.
Figure 7A:
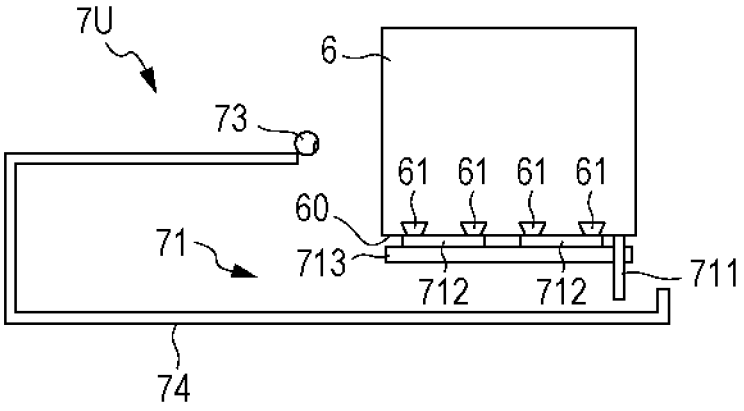
FIGS. 7A and 7B are schematic views illustrating the states of the print head and the maintenance unit.
Figure 7B:
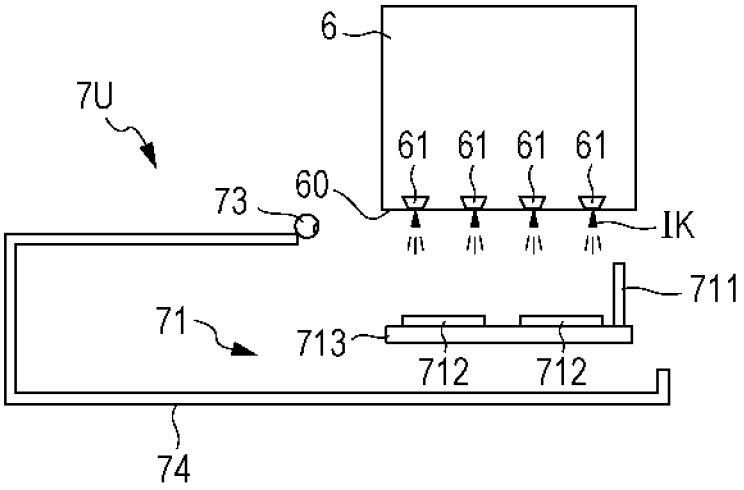

Subsequently, the pressure cleaning will be described. FIG. 6 is a flowchart illustrating the flow of the pressure cleaning, and FIGS. 7A and 7B are schematic views illustrating states of the print head and the maintenance unit. In the pressure cleaning, the ink circulation mechanism 80 (FIG. 2) first accelerates the circulation speed of ink up to a pressure speed which is higher than a normal speed when a print operation is performed in response to an operation signal from the control unit 100 in step S101.

Subsequently, as shown in FIG. 7A, after the moving body 71 of the maintenance unit 7U is moved to the lower side of the print head 6, the print head 6 is moved to a capping location which is further on the lower side than the cleaning location, and thus the nozzle forming surface 60 is pressed by the caps 712 and all of the nozzles 61 are capped in step S102. Meanwhile, the wiper 711 normally maintains a state in which the wiper 711 protrudes toward the upper side from the support member 713 by an energization member which is not shown in the drawing. However, when the print head 6 is moved to the capping location, the print head 6 resists the energization member, and thus the wiper 711 is moved to the lower side. Therefore, the wiper 711 does not disturb capping.

If the capping is completed, the ink is pressed by the ink circulation mechanism 80 in step S103. If the ink is sufficiently pressed, the capping is released by moving the print head 6 to the retracted location in step S104. When the capping is released, pressed ink IK is discharged from the nozzles 61 as shown in FIG. 7B. At this time, the cleaning liquid, bubbles, and the like in the nozzles 61 are released from the nozzles 61 together with the ink IK which is discharged from the nozzles 61. As described above, if the capping is released and the ink is discharged from the nozzles 61, pressing of the ink stops in step S105.

In the pressure cleaning, the wiping is further performed on the nozzle forming surface 60 in step S106. Here, it is possible to use various forms of wiping. For example, the wiper 711 may be moved from the start point P1 to the end point P2 only one time without supplying the cleaning liquid. Accordingly, the ink, which is discharged from the nozzles 61 and adheres to the nozzle forming surface 60, is wiped away. Subsequently, after the circulation speed of the ink is reduced to a normal speed in step S107, flushing in which the ink is discharged from all of the nozzles 61 is performed, and thus the nozzles 61 are filled with the ink in a state in which suitable meniscus are formed in step S108. If the above-described pressure cleaning ends, the process returns to the flowchart of FIG. 4, steps S12 and S13 are performed, and the maintenance ends.

As described above, in the embodiment, the reciprocating wiping, in which the wiper 711 which holds the supplied cleaning liquid is caused to perform the reciprocating operation between the start point P1 and the end point P2 in the wiping direction Dw, is performed. As above, when the wiper 711 is caused to perform the reciprocating operation, the cleaning liquid widely and uniformly spreads on the nozzle forming surface 60, and thus it is possible to sufficiently spread the cleaning liquid. As a result, it is possible to perform effective cleaning using the cleaning liquid.

In addition, in the reciprocating wiping, the reciprocating operation of the wiper 711 is performed a plurality of times (five times). When the wiper 711 performs the reciprocating operation a plurality of times as above, it is possible to further suitably spread the cleaning liquid. At the same time, a force generated by the wiper 711 is applied to the extraneous substance, such as cured ink or the like, which adheres to the nozzle forming surface 60 a plurality of times from both directions of the wiping direction Dw, and thus it is possible to realize suitable scraping.

Further, when the pressure cleaning is performed after the reciprocating wiping is performed, it is possible to release the cleaning liquid, which comes in the nozzles 61 when the reciprocating wiping is performed, from the nozzles 61 while the ink is discharged. In addition, when the wiping is performed without using the cleaning liquid in the pressure cleaning, it is possible to clean the nozzle forming surface 60 which is stained when the ink is discharged while preventing the cleaning liquid from coming in the nozzles 61.

Figure 8:
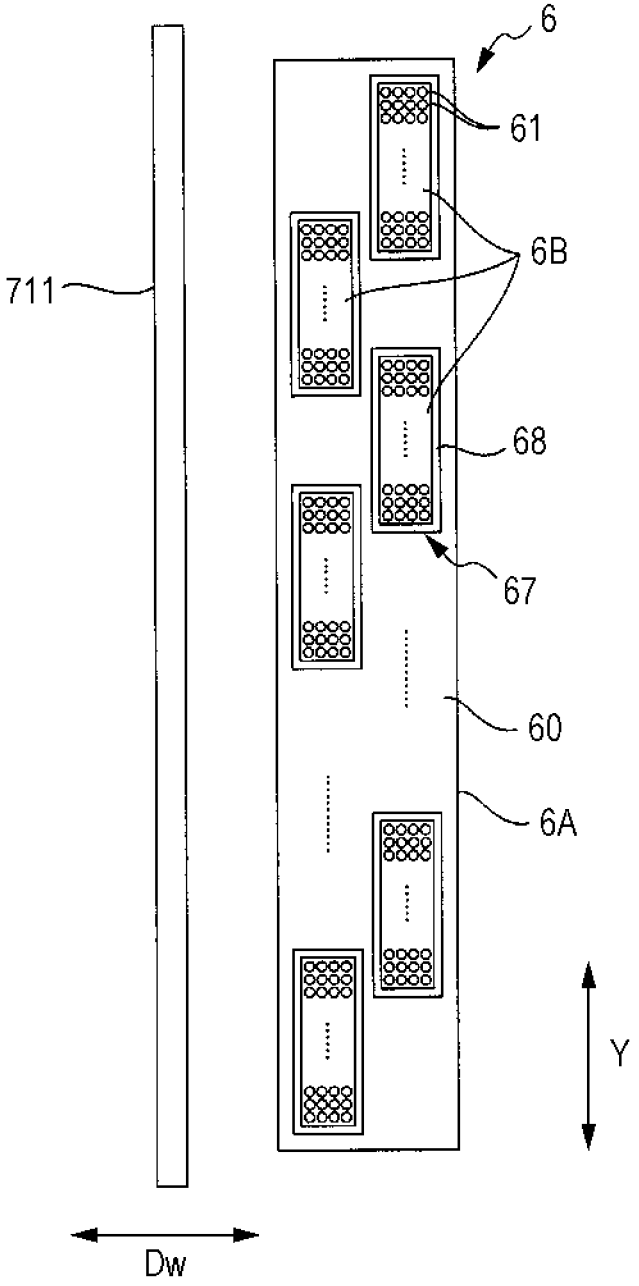
FIG. 8 is a schematic view illustrating a detailed nozzle forming surface.

Here, the detailed configuration of the print head 6 according to the embodiment and a configuration which is appropriate for performing wiping on the nozzle forming surface 60 of the print head 6 will be described. FIG. 8 is a schematic view illustrating the detailed nozzle forming surface. The print head 6 includes a housing 6A formed of a plurality of accommodation spaces 67 which open toward the nozzle forming surface 60, and unit heads 6B which are accommodated one by one in the respective accommodation spaces 67.

The plurality of accommodation spaces 67 are provided in the Y direction and form columns. The accommodation spaces 67 are arranged in zigzags in such a way that two columns are provided in the wiping direction Dw which is perpendicular to the Y direction while locations are shifted in the Y direction. In addition, in each unit head 6B, the nozzles 61 are 2-dimensionally arranged in such a way that nozzle lines are formed by providing the plurality of nozzles 61 in the direction (Y direction) which is perpendicular to the wiping direction Dw and the plurality of nozzle columns are arranged in the wiping direction Dw. Each unit head 6B is fixed to the housing 6A by filling a space between the side surface of the unit head 6B and the inner wall surface of the accommodation space 67 with an adhesive agent in a state in which the unit head 6B is arranged one by one in each accommodation space 67. At this time, there is a case in which a groove portion 68 is formed in the nozzle forming surface 60 between the housing 6A and the unit head 6B due to the shrinking or filling state of the adhesive agent or the like.

If time elapses in a state in which the extraneous substance that is scraped from the nozzle forming surface 60 comes in a narrow space, such as the groove portion 68, together with the cleaning liquid, the extraneous substance comes deep in the groove portion 68 due to capillary action, and thus a problem occurs in that it is difficult to remove the extraneous substance from the groove portion 68. Here, in the embodiment, when the length of the wiper 711 in the Y direction is longer than the length of the nozzle forming surface 60 in the Y direction, the wiper 711 abuts on the entire region of the nozzle forming surface 60 when the reciprocating wiping is performed. In this way, it is possible to perform suitable cleaning in such a way that the wiper 711 passes through above each of the groove portion 68 when the reciprocating wiping is performed, and the extraneous substance is scraped from the groove portion 68 together with the cleaning liquid before the extraneous substance comes deep in the groove portion 68.

Meanwhile, the above-described problem is not limited to the groove portion 68 between the housing 6A and the unit head 6B and the problem may occur in a minute depression which is present on the nozzle forming surface 60. However, even in a depression other than the groove portion 68, it is possible to perform suitable cleaning like in the above in such a way that the wiper 711 passes through above the depression when the reciprocating wiping is performed.

However, although description is omitted above, it is possible to perform further suitable wiping in such a way that a moving speed of the wiper 711 which is acquired when the wiping is performed or an abutting force in which the wiper 711 abuts on the nozzle forming surface 60 are appropriately adjusted. Hereinafter, the details will be described.

In the embodiment, the reciprocating operation of the wiper 711 is performed five times in the reciprocating wiping. However, for example, after low speed control in which the speed of a first reciprocating operation is set to a first speed is performed, it is possible to perform high speed control in which the speed of four remaining reciprocating operations is set to a second speed which is faster than the first speed. More specifically, if steps S5 and S7 are performed when N=0 in the flowchart of FIG. 4, the wiper 711 moves at the first speed which is a comparatively low speed and performs the wiping in such a way that the control unit 100 issues an operational instruction indicative of low speed control to the wiper driving mechanism 72. In contrast, if steps S5 and S7 are performed when N=1 to 4, the wiper 711 moves at the second speed which is a comparatively high speed and performs the wiping in such a way that the control unit 100 issues an operational instruction indicative of high speed control to the wiper driving mechanism 72.

As above, when the low speed control in which the speed of the wiper 711 is comparatively low is performed in an early stage of the reciprocating wiping, it is possible to securely spread the cleaning liquid on the nozzle forming surface 60. Besides, when the high speed control is performed after the low speed control is performed, it is possible to prevent time that is necessary for the entire reciprocating wiping from being long. Meanwhile, even though the low speed control is performed only when a first movement from the start point P1 to the end point P2 of the wiper 711 or the low speed control is subsequently performed in a second or subsequent reciprocating operation, the same advantages can be acquired. Further, it is not necessary to change the moving speed of the wiper 711 in a second stage. The moving speed may be changed in a third or higher stage, and the speed may be gradually changed.

Figure 9A:
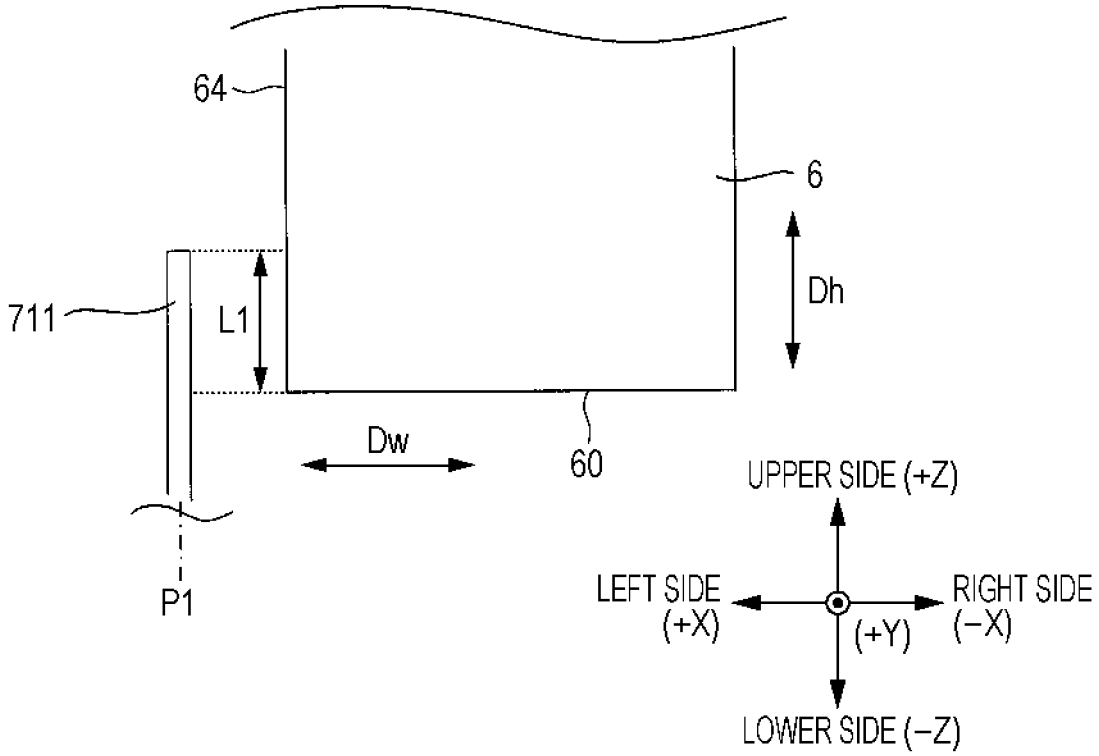
FIGS. 9A and 9B are schematic views illustrating the adjustment of an abutting force which is applied to the nozzle forming surface performed by a wiper.
Figure 9B:
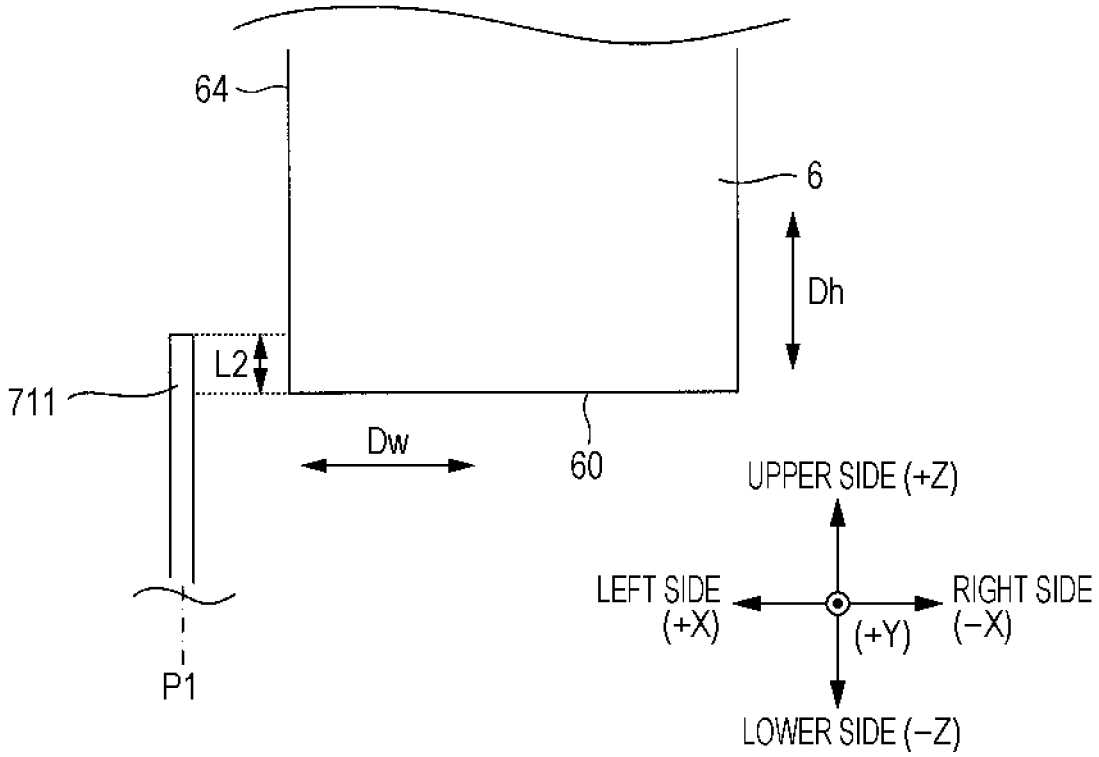

In addition, in the embodiment, the abutting force, in which the wiper 711 abuts on the nozzle forming surface 60 and which is acquired when the reciprocating wiping is performed, is greater than the abutting force which is acquired when the wiping is performed in the pressure cleaning. FIGS. 9A and 9B are schematic views illustrating the adjustment of the abutting force applied to the nozzle forming surface by the wiper. More specifically, FIG. 9A illustrates a state when the reciprocating wiping is performed and FIG. 9B illustrates a state when the wiping is performed in the pressure cleaning.

In a state in which a process is completed up to step S3 of FIG. 4, the wiper 711 is located at the start point P1, the print head 6 is present in the cleaning location, and the liquid supplied surface 64 of the print head 6 overlaps with the wiper 711 in the receding direction Dh by a distance L1 as shown in FIG. 9A. Further, when the wiper 711 moves in the wiping direction Dw in this state, the wiping is performed in such a way that the tip portion of the wiper 711 abuts on the nozzle forming surface 60 in a state in which the tip portion of the wiper 711 is bent. That is, when the reciprocating wiping is performed, the tip portion of the wiper 711 is bent depending on the distance L1, and the tip portion of the wiper 711 abuts on the nozzle forming surface 60 based on the abutting force depending on the restoring force (elastic force) which causes the wiper 711 to be restored to an erect state from a bent state.

In contrast, when the wiping in step S106 of FIG. 6 starts in the pressure cleaning, according to the operational instruction from the control unit 100, head driving mechanism 69 causes the print head 6 to be arranged in an upper side location than the cleaning location (refer to FIG. 9A), as shown in FIG. 9B. As a result, a distance in which the liquid supplied surface 64 of the print head 6 overlaps with the wiper 711 in the receding direction Dh is the distance L2 which is shorter than the distance L1. Further, if the wiper 711 moves in the wiping direction Dw in this state and the wiping is performed, a degree to which the tip portion of the wiper 711 is bent is smaller than a degree which is acquired when the reciprocating wiping is performed. As a result, the abutting force which is applied to the nozzle forming surface 60 according to the restoring force of the wiper 711 is less than the abutting force which is acquired when the reciprocating wiping is performed. In other words, the abutting force which is acquired when the reciprocating wiping is performed is greater than the abutting force which is acquired when the wiping is performed in the pressure cleaning.

As above, when the abutting force, in which the wiper 711 abuts on the nozzle forming surface 60 and which is acquired when the reciprocating wiping is performed, is greater than the abutting force which is acquired when the wiping is performed in the pressure cleaning, it is possible to suitably spread the cleaning liquid to the nozzle forming surface 60 while securely pressing the cleaning liquid by the wiper 711 when the reciprocating wiping is performed. In contrast, when the wiping is performed in the pressure cleaning, only non-cured ink which adheres to the nozzle forming surface 60 due to ink discharge from an immediately preceding nozzle 61 is wiped, and thus it is possible to sufficiently clean the nozzle forming surface 60 even when the abutting force which is generated by the wiper 711 is small.

Meanwhile, when a location of the wiper 711 is changed in the receding direction Dh instead of or in addition to the change in the location of the print head 6 in the receding direction Dh, it is possible to change the relative locations of the print head 6 and the wiper 711 in the receding direction Dh and to adjust the abutting force. In addition, it is possible to appropriately change timing at which the print head 6 or the wiper 711 is moved in the receding direction Dh. For example, after the wiper 711 abuts on the nozzle forming surface 60, it is possible to change the location of the print head 6 or the wiper 711 in the receding direction Dh and to adjust the abutting force.

As described above, in the embodiment, the printer 1 corresponds to a "liquid discharging apparatus" according to the aspect of the invention, the ink corresponds to "liquid" according to the aspect of the invention, the print head 6 corresponds to "discharge head" according to the aspect of the invention, the wiper 711 corresponds to a "wiping member" according to the aspect of the invention, the cleaning liquid supply pipe 73 corresponds to a "cleaning liquid supply unit" according to the aspect of the invention, the direction which faces the end point P2 from the start point P1 corresponds to a "first direction" according to the aspect of the invention, the direction which faces the start point P1 from the end point P2 corresponds to a "second direction" according to the aspect of the invention, steps S5 to S10 which are performed by the control unit 100 when the reciprocating wiping is performed correspond to "reciprocating wiping control" according to the aspect of the invention, and steps S101 to S108 which are performed by the control unit 100 when the pressure cleaning is performed correspond to "cleaning control" according to the aspect of the invention.

Meanwhile, in the above description, the content of the maintenance has been described for a case in which the nozzle forming surface 60 is substantially horizontal for convenience of explanation. However, even when the nozzle forming surface 60 is inclined from a horizontal plane, it is apparent that it is possible to perform the maintenance which has been described so far by arranging the maintenance unit 7U in the wiping direction Dw along the nozzle forming surface 60.

In addition, the invention is not limited to the above embodiment, and it is possible to appropriately combine the components of the embodiment and to apply various changes without departing from the gist of the invention. For example, in the embodiment, the cleaning liquid is supplied to the liquid supplied surface 64 which is the side surface of the print head 6. However, the cleaning liquid may be directly supplied to the wiper 711. In this case, the cleaning liquid may be supplied in the vicinity of the upper end of the wiper 711 such that the cleaning liquid flows into the wiping surface 711*a* of the wiper 711 and is held by the wiper 711.

In addition, in the embodiment, the wiping is performed by moving the wiper 711 in the wiping direction Dw. However, the wiping may be performed by moving the nozzle forming surface 60, that is, the print head 6, in the wiping direction Dw. In addition, it is possible to perform the wiping by moving both the wiper 711 and the print head 6 in the wiping direction Dw.

In addition, in the embodiment, the low speed control or the high speed control is performed on the wiper 711 when the reciprocating wiping is performed. However, the control performed to change the moving speed of the wiper 711 as described above is not an essential requirement. The moving speed of the wiper 711, which is acquired when the reciprocating wiping is performed, may be uniformly maintained.

In addition, in the embodiment, the abutting force, in which the wiper 711 abuts on the nozzle forming surface 60 and which is acquired when the reciprocating wiping is performed, is greater than the abutting force which is acquired when the wiping is performed in the pressure cleaning. However, the change in the abutting force as described above is not an essential requirement for the invention. When the reciprocating wiping is performed and when the wiping is performed in the pressure cleaning, the relative locations of the print head 6 and the wiper 711 in the receding direction Dh may be uniformly maintained.

In addition, in the embodiment, it is possible to appropriately change the flows shown in FIGS. 4 and 6. For example, the number of times that the wiper 711 performs the reciprocating operation may be changed, and the operation performed for the pressure cleaning may be changed. Moreover, it is possible to omit the pressure cleaning.

In addition, it is possible to appropriately change the detailed configuration of the printer 1, the arrangement or the number of the print heads 6 and the maintenance units 7U may be appropriately changed, or the shape or the like of the platen drum 30 may be appropriately changed.

In addition, the kind of the ink which is discharged from the nozzles 61 is not limited to the above-described UV ink.

Further, it is possible to apply the invention to a liquid discharging apparatus which discharges liquid other than the ink.

The entire disclosure of Japanese Patent Application No. 2013-045074, filed Mar. 7, 2013 is expressly incorporated by reference herein.

What is claimed is:

1. A liquid discharging apparatus comprising:

a discharge head that includes a nozzle forming surface on which nozzles for discharging liquid are formed;

a wiping member that performs wiping by relatively moving on the nozzle forming surface while abutting on the nozzle forming surface;

a cleaning liquid supply unit that supplies cleaning liquid provided for the wiping to a first side surface of the discharge head; and a control unit that performs reciprocating wiping control which performs the wiping by causing the wiping member for holding the cleaning liquid supplied from the cleaning liquid supply unit to perform a reciprocating operation in which, after relative movement is performed in a first direction along the nozzle forming surface, relative movement is performed in a second direction which is opposite to the first direction, wherein the control unit performs the relative movement in the first direction so that an end point of the relative movement in the first direction is located on a lower side of the discharge head, wherein the wiping member is bent to a first state while moving in the first direction so as to move the cleaning liquid from the first side surface to the nozzle forming surface and is bent to a second state that is opposite the first state while moving in the second direction.

2. The liquid discharging apparatus according to claim 1, wherein, in the reciprocating wiping control, the control unit causes the wiping member to perform the reciprocating operation a plurality of times.

3. The liquid discharging apparatus according to claim 1, wherein, in the reciprocating wiping control, the control unit performs low speed control in which first relative movement of the wiping member is performed in at least the first direction at a first speed, and high speed control in which the relative movement of the wiping member is performed at a second speed which is faster than the first speed after the low speed control is performed.

4. The liquid discharging apparatus according to claim 1, wherein, after the reciprocating wiping control is performed, the control unit further performs cleaning control in which the wiping is performed without supplying the cleaning liquid after the liquid is discharged from the nozzles.

5. The liquid discharging apparatus according to claim 4, wherein the control unit causes an abutting force, in which the wiping member abuts on the nozzle forming surface and which is acquired when the wiping is performed under the reciprocating wiping control, to be greater than an abutting force acquired when the wiping is performed under the cleaning control.

6. The liquid discharging apparatus according to claim 1, wherein a depression is formed in a region of the nozzle forming surface on which the nozzles are not formed, and wherein the control unit, when the wiping is performed under the reciprocating wiping control, causes the wiping member to perform the reciprocating operation such that the wiping member passes through above the depression.

7. The liquid discharging apparatus according to claim 6, wherein the discharge head includes a unit head in which the nozzles are provided, and a housing in which an accommodation space is formed in order to accommodate the unit head, and wherein the depression is a groove portion which is formed between the unit head and the housing in a state in which the unit head is accommodated in and fixed to the accommodation space.

8. A method of cleaning a discharge head in a liquid discharging apparatus which includes the discharge head that includes a nozzle forming surface on which nozzles for discharging liquid are formed, and a wiping member that performs wiping by relatively moving on the nozzle forming surface while abutting on the nozzle forming surface, comprising:

supplying the cleaning liquid provided for the wiping to a first side surface of the discharge head; and performing the wiping by causing the wiping member, which holds the cleaning liquid supplied in the supplying of the cleaning liquid, to perform a reciprocating operation in which, after relative movement is performed in a first direction along the nozzle forming surface, relative movement is performed in a second direction which is opposite to the first direction, wherein the relative movement in the first direction has an end point located on a lower side of the discharge head, wherein the wiping member is bent to a first state while moving in the first direction so as to move the cleaning liquid from the first side surface to the nozzle forming surface and is bent to a second state that is opposite the first state while moving in the second direction.

* * * * *